US007574154B2

(12) United States Patent
Kobayashi et al.

(10) Patent No.: US 7,574,154 B2
(45) Date of Patent: Aug. 11, 2009

(54) IMAGE FORMING APPARATUS WITH MOVING SPEED RATIO CHANGE SECTION AND IMAGE FORMING METHOD INCLUDING CHANGING CIRCUMFERENTIAL SPEED RATIO

(75) Inventors: Kazutoshi Kobayashi, Hachioji (JP); Yutaka Miyasaka, Machida (JP); Mineyuki Sako, Toyokawa (JP); Nobuyasu Tamura, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 439 days.

(21) Appl. No.: 11/473,101

(22) Filed: Jun. 22, 2006

(65) Prior Publication Data

US 2007/0053706 A1 Mar. 8, 2007

(30) Foreign Application Priority Data

Sep. 7, 2005 (JP) ..... 2005-259051

(51) Int. Cl.
*G03G 15/06* (2006.01)
*G03G 15/08* (2006.01)

(52) U.S. Cl. ..... 399/55; 399/53

(58) Field of Classification Search ..... 399/53, 399/55, 302, 308
See application file for complete search history.

(56) References Cited

U.S. PATENT DOCUMENTS 5,517,283 A * 5/1996 Hori et al. ..... 399/55 X
5,805,956 A * 9/1998 Kawai et al. ..... 399/55 X
7,158,733 B2 * 1/2007 Doi et al. ..... 399/55

FOREIGN PATENT DOCUMENTS

JP 05-224512 9/1993

* cited by examiner

*Primary Examiner*—Sandra L Brase
(74) *Attorney, Agent, or Firm*—Cantor Colburn LLP

(57) ABSTRACT

An image forming apparatus includes: a moving speed ratio change section which changes a circumferential speed ratio between a surface of a developer bearing member and a surface of an image carrier; and a memory section which stores a target value of fog toner. After the circumferential speed ratio has been changed by the moving speed ratio change section, a controller determines a fog control parameter based on comparing the value detected by the fog toner detection section with the target value stored in the memory section. After then, and the controller controls the moving speed ratio change section to return the circumferential speed ratio to the circumferential speed ratio prior to the change.

13 Claims, 6 Drawing Sheets

IMAGE FORMING APPARATUS WITH MOVING SPEED RATIO CHANGE SECTION AND IMAGE FORMING METHOD INCLUDING CHANGING CIRCUMFERENTIAL SPEED RATIO

This application is based on Japanese Patent Application No. 2005-259051 filed on Sep. 7, 2005, which is incorporated hereinto by reference.

BACKGROUND OF THE INVENTION

The present invention relates to an image forming apparatus and image forming method based on electrophotographic technology.

In an image forming apparatus based on electrophotographic technology, a developer bearing member for bearing the developer (toner in the case of a one-component development, and toner and carrier in the case of a two-component development) is moved relative to the photoreceptor with an electrostatic latent image formed thereon, whereby the electrostatic latent image on the photoreceptor is developed. In this case, to ensure that the background fog (toner adhered to the background where toner should not adhere) does not occur, a potential difference is provided between the surface potential of the photoreceptor background portion and the bias potential of the developer bearing member (hereinafter referred to simply as "development bias" in some cases).

However, even if a proper potential difference is provided between the surface potential of the photoreceptor background portion and the bias potential of the developer bearing member, the characteristics of the developer such as the amount of charged toner and quantity of the developer are changed by a change with the passage of time due to large number of printing, environmental condition change and long period of time to be left, with the result that a background fog (hereinafter referred to simply as "fog" in some cases) occurs.

One of the efforts to solve this problem is disclosed in the Patent Document 1 (Japanese Non-Examined Patent Publication: Tokkaihei 5-224512) wherein toner density of toner fog is detected by a toner sensor while the development bias is changed, and the characteristic curve of toner density with respect to development bias is obtained. If the development bias capable of outputting the toner density when toner is no adhered is higher than a reference level, copying operation is carried out by increasing development bias by a predetermined amount, thereby solving the problem caused by a rise in fogging level.

However, the amount of toner adhered due to fog is very small. The conventional optical sensor described in the Patent Document 1 and others has been characterized by poor detection accuracy and poor reliability. This has been the problem yet to be solved in the conventional method.

SUMMARY OF THE INVENTION

The object of the present invention is to solve the aforementioned problems and to provide an image forming apparatus and image forming method wherein fog detection accuracy is improved in such a way that a high degree of reliability is ensured without fog occurring in spite of large number or printing, environmental condition change or long period of time to be left.

The aforementioned object can be solved by any one of the following Structures.

An image forming apparatus containing: an image carrier with movable surface; a charging unit for electrically charging the surface of the image carrier; an exposure unit for imagewise exposing the surface of the image carrier charged by the charging unit so as to form an electrostatic latent image; a developing unit having a developer bearing member to hold a toner thereon, which develops the electrostatic latent image by moving a surface of the developer bearing member relative to a surface of the image carrier; a fog toner detection section for detecting the value corresponding to the amount of fog toner adhered from the developer bearing member; and a controller for determining the fog control parameter based on the result of detection by the fog toner detection section. The image forming apparatus further contains: a moving speed ratio change section for changing the circumferential speed ratio between the surface of the developer bearing member and a surface of the image carrier; and a memory section for storing a target value of fog toner. The controller provides fog control in such a way that, after the circumferential speed ratio has been changed by the moving speed ratio change section, the value detected by the fog toner detection section is compared with the target value stored by the memory section, and the fog control parameter is determined, after then the circumferential speed ratio is returned to the circumferential speed ratio prior to the change.

DETAILED DESCRIPTION OF THE PREFERRED EMBODIMENT (Overall Structure and Basic Operation of an Apparatus)

An example of applying the present invention to a tandem type full color image forming apparatus will be taken to explain the best form of embodiment of the present invention, without the present invention being restricted thereto.

Figure 1:
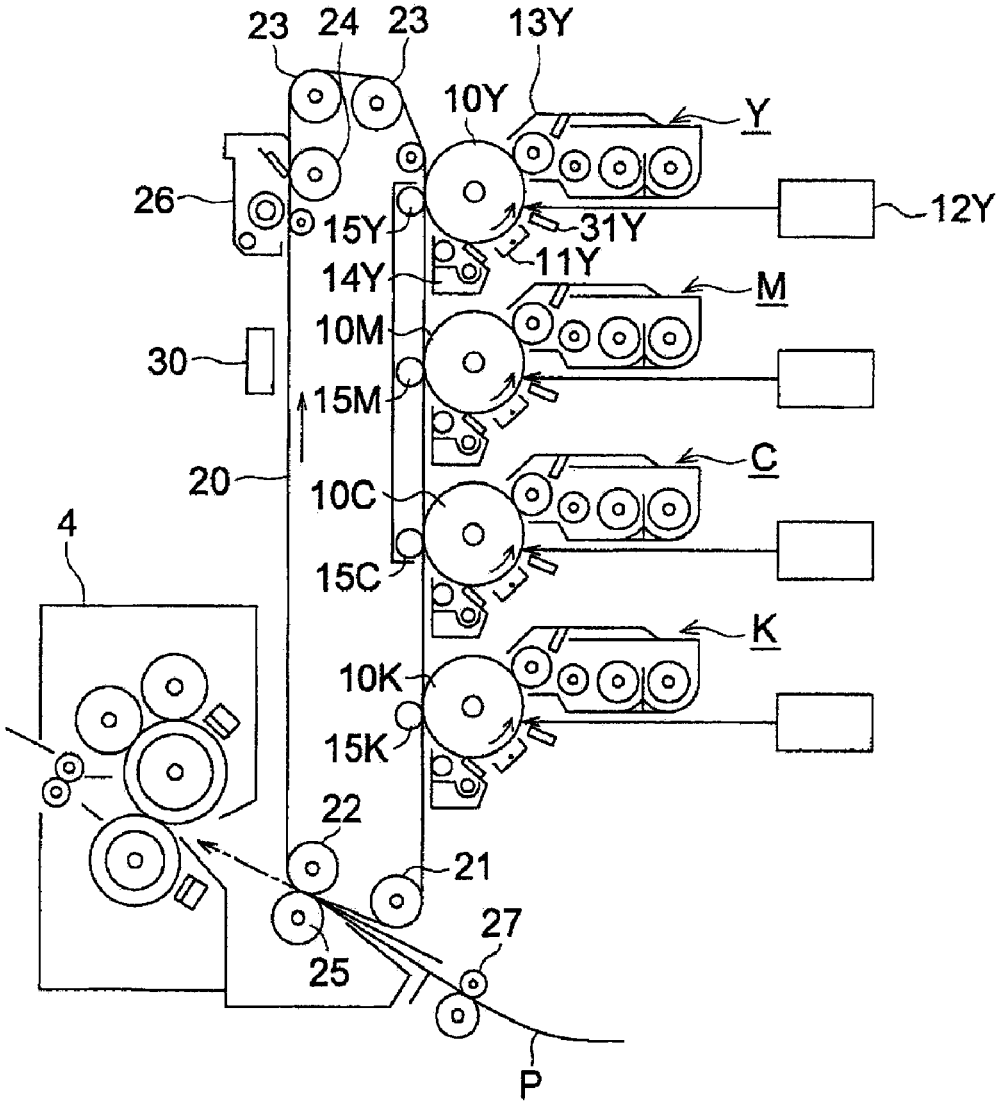
FIG. 1 is a schematic diagram representing an image forming apparatus of the present embodiment.

FIG. 1 is a schematic diagram representing an image forming apparatus of the present embodiment. The yellow image forming section Y, magenta image forming section M, cyan image forming section C, and black image forming section K are provided in the traveling direction of the intermediate transfer member 20. In the yellow image forming section Y, a charging unit 11Y, exposure unit 12Y, developing device 13Y, cleaning device 14Y, surface potential sensor 31Y are arranged around a photoreceptor 10Y in the rotating direction of the photoreceptor 10Y. An exposure unit 12Y exposes imagewise the surface of the photoreceptor 10Y uniformly charged by the charging unit 11Y so that a latent image is formed. When this latent image has been developed by the developing device 13Y, a yellow toner image is formed on the surface of the photoreceptor 10Y.

A primary transfer roller 15Y as a transfer unit is arranged on the side opposite to the yellow image forming section Y wherein the intermediate transfer member 20 is located in-between. When a predetermined voltage is applied to the primary transfer roller 15Y, a yellow toner image on the photoreceptor 10Y is transferred onto the intermediate transfer member 20. In the meantime, the surface of the photoreceptor 10Y having passed the side opposed to the primary transfer roller 15Y reaches the side opposed to the cleaning device 14Y, and the residual toner without being been transferred by the primary transfer roller 15Y is collected by the cleaning device 14Y.

The magenta image forming section M, cyan image forming section C, and black image forming section K have the same structure as that of the yellow image forming section Y, and will not be described to avoid duplication.

The image forming apparatus of the present embodiment has two modes, namely, a monochromatic mode and a full color mode. In the monochromatic mode, the contact pressure of primary transfer rollers 15Y, 15M and 15C to photoreceptor 10Y, 10M, 10C is released. The portion of the intermediate transfer member 20 opposed to the primary transfer rollers 15Y, 15M and 15C is kept apart by the photoreceptors 10Y, 10M and 10C. The primary transfer rollers 15Y, 15M and 15C are integrated into one unit. The contact pressures of the primary transfer rollers 15Y, 15M and 15C are released synchronically. In the full color mode, contact pressures of all the primary transfer rollers 15Y, 15M, 15C and 15K are applied. The contact pressure of the primary transfer roller 15K is always applied to the photoreceptor 10K whether in the monochromatic or full color mode.

The toner images formed in the image forming sections Y, M, C and K are superimposed on the intermediate transfer member 20, whereby a full color toner image is formed.

The intermediate transfer member 20 is designed in a belt-shaped structure and is entrained about the drive roller 21, earth roller 22, tension roller 23 and driven roller 24. The intermediate transfer member 20 is moved by rotation of the drive roller 21 by a drive motor (not illustrated).

A secondary transfer roller 25 is provided on the side opposite to the earth roller 22 wherein the intermediate transfer member 20 is located in-between. A path is arranged between the intermediate transfer member 20 and secondary transfer roller 25, and the recording medium P having passed through a timing roller 27 runs through this path. When a predetermined voltage is applied to the secondary transfer roller 25, the full color toner image on the intermediate transfer member 20 is transferred to the recording medium P. The fixing unit 4 is used to fix the image on the recording medium P subsequent to transfer.

A cleaning unit 26 is provided on the side opposite the driven roller 24 wherein the intermediate transfer member 20 is located in-between. The remaining toner without having been transferred by the secondary transfer roller 25 is collected.

A fog detection sensor 30 is arranged opposite the position downstream from the secondary transfer roller 25 of the intermediate transfer member 20 and upstream from the cleaning unit 26. In the fog control to be described later, the fog images formed by the image forming sections Y, M, C and K are transferred onto the intermediate transfer member 20 by the primary transfer rollers 15Y, 15M, 15C and 15K. The amount of the fog toner is detected by the fog detection sensor 30. When the fog is detected, transfer by the secondary transfer roller 25 is not performed.

(Structure of Image Forming Section and the Process of Image Formation)

Figure 2:
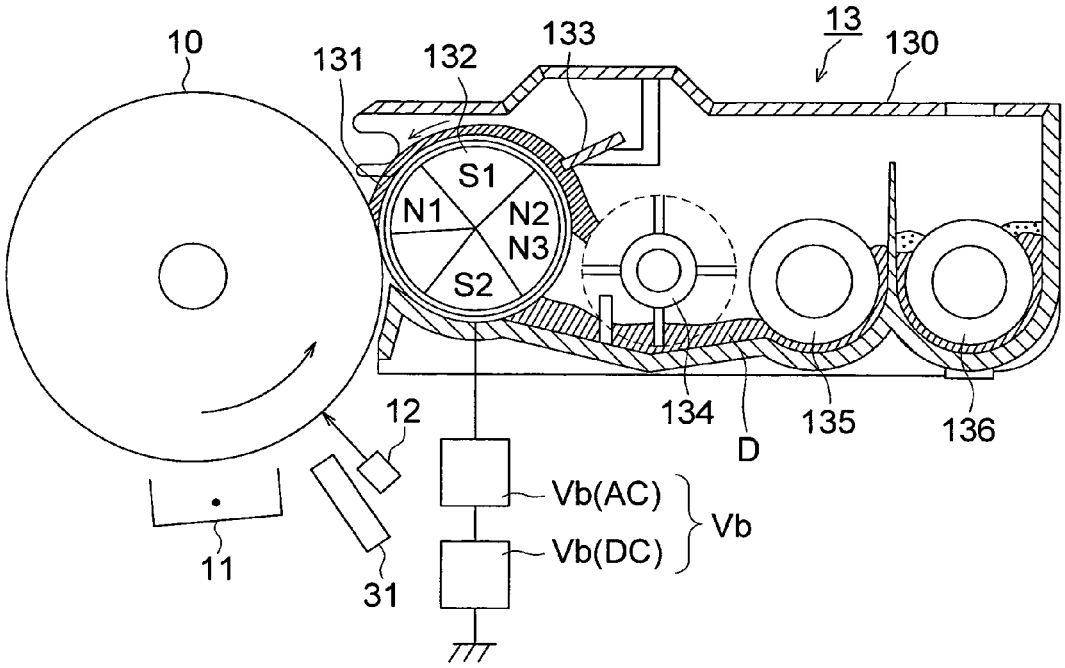
FIG. 2 is a schematic diagram representing an image forming section of the present embodiment.

FIG. 2 is a detailed drawing of the image forming sections Y, M, C and K of FIG. 1. The image forming sections Y, M, C and K are designed in one and the same structure. Accordingly, the following description will omit the symbols Y, M, C and K at the ends of the components of the image forming sections.

The following describes the present embodiment with an example taken from the case of reversal development by applying a negative development bias using a negatively charged photoreceptor and negatively charged toner. However, the present invention is not restricted thereto. The present invention is also applicable to reversal development by applying a positive development bias using a positively charged photoreceptor and positively charged toner. The present invention is applicable to the normal development as well.

The photoreceptor 10 is a negatively charged photoreceptor, which turns in the arrow-marked direction in the drawing. A phthalocyanine based photoreceptor can be used as a negatively charged photoreceptor.

The charging unit 11 allows the surface of the photoreceptor 10 to be negatively charged. A charging unit such as a scorotron charging unit and roller charging unit can be used. A surface potential sensor 31 is used for charged potential control. When the value read by the surface potential sensor 31 is fed back to the output of the charging unit 11, the charged potential can be placed under control.

In response to the image data, the exposure unit 12 exposes imagewise the photoreceptor 10 negatively charged by the charging unit 11 so that a latent image is formed on the surface of the photoreceptor 10. A semiconductor laser and LED (Light Emitting Diode) array can be used as a light source of the exposure unit 12.

The developing device 13 of the present embodiment will be described in the case of using a two-component developing device is used. It is to be understood, however, that the one-component developing device can be used. A developer mainly composed of toner and carrier is incorporated in the casing 130. The toner is negatively charged toner negatively charged by triboelectric charging with the carrier.

A development sleeve 131 carries a developer D and turns in the arrow-marked direction of the drawing (moves in the direction opposite the photoreceptor traveling direction at the position opposed to the photoreceptor). This allows the developer D to be supplied to the portion opposed to the photoreceptor 10. A magnet roll 132 for retaining the developer on the development sleeve by magnetic force is fixed inside the development sleeve 131. A regulating blade 133 for regulating the amount of developer on the development sleeve 131 is arranged inside the casing 130 at the position opposed to the development sleeve 131. A paddle roller 134 for supplying a developer to the development sleeve 131 is provided upstream of the regulating blade 133 in the rotating direction of the development sleeve 131, opposed to the development sleeve 131. The conveyance screws 135 and 136 are arranged on the side opposed to the development sleeve 131 through the paddle roller 134. These screws are used to circulate, mix and stir the developer inside the casing 130.

In the developer having been circulated, mixed and stirred by the conveyance screws 135 and 136, toner is negatively charged and the carrier is positively charged by triboelectric charging between toner and carrier. The charged developer is supplied to development sleeve 131 through the paddle roller 134. The height of the developer having been supplied to the development sleeve 131 is regulated by the regulating blade 133, and is supplied to the portion opposite to the photoreceptor 10.

The development bias Vb for controlling the amount of toner adhered to the photoreceptor 10 is applied to the development sleeve 131. The development bias Vb of the present embodiment will be explained using an example of a development bias wherein DC component Vb (DC) and AC component Vb (AC) are superimposed. The development bias made up of a DC component alone can also be utilized.

Figure 3:
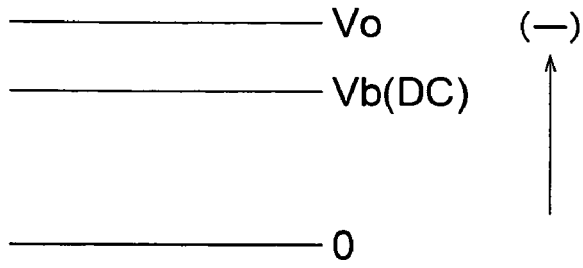
FIGS. 3(*a*) through 3(*c*) are transition diagrams representing the relationship between the photoreceptor potential and development bias potential in an image forming process.
Figure 3:
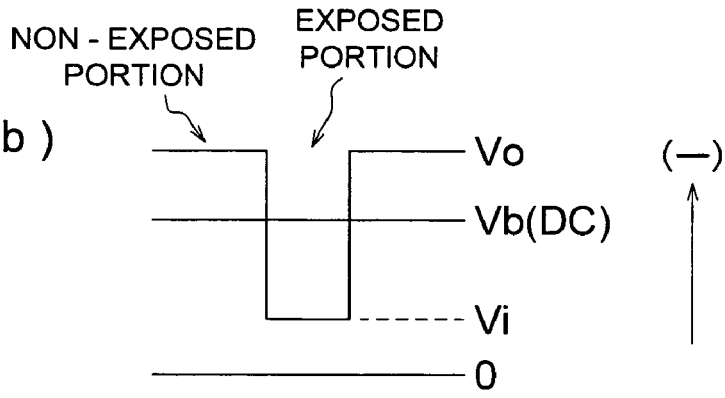
Figure 3:
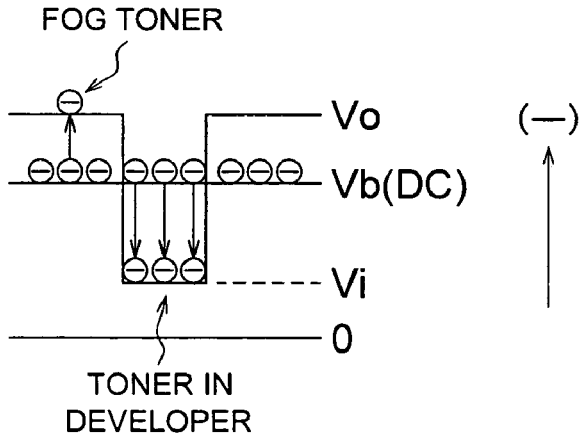

FIGS. 3 (*a*) through 3 (*c*) are transition diagrams representing the relationship between the photoreceptor potential and development bias potential in an image forming process. Firstly, the surface of the photoreceptor 10 is negatively and uniformly charged by the charging unit 11. In this case, the reading of the surface potential sensor 31 is fed back to the charging unit 11 and the photoreceptor 10 is charged to a predetermined charged potential (V0) (FIG. 3(*a*)).

The surface of the photoreceptor 10 charged to have a predetermined negative potential is exposed imagewise by the exposure unit 12 based on the image data. This procedure reduces the absolute value of the negative potential of the exposed portion (Vi), so that an electrostatic latent image is formed (FIG. 3(*b*)).

The surface of the photoreceptor 10 with an electrostatic latent image formed thereon reaches the portion opposed to the development sleeve 131, where development is carried out. The development bias Vb is applied to the development sleeve 131, and toner in the developer adheres to the portion exposed imagewise by an exposure unit 12. Further, if the difference between the surface potential V0 and potential of the development bias Vb (DC) is not sufficiently great, fog toner will adhere to the non-exposed portion (FIG. 3(*c*)).

(Fog Control)

Figure 4:
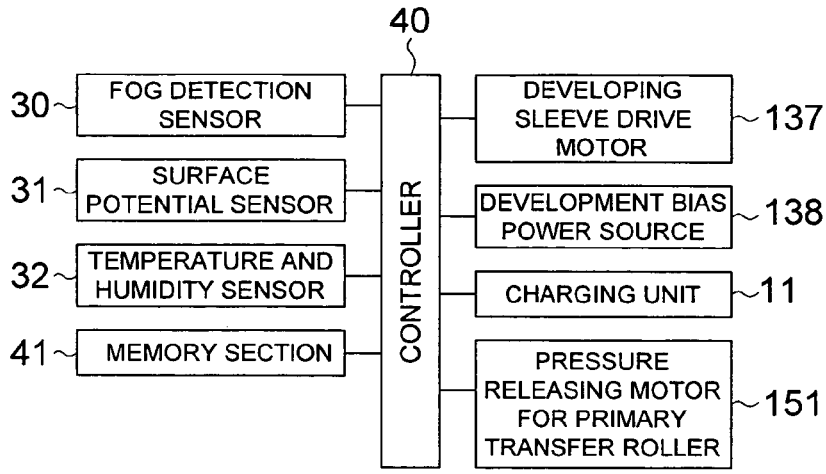
FIG. 4 is a block diagram representing the fog control structure of the present embodiment.

FIG. 4 is a block diagram representing a fog control structure of the present embodiment. It shows only the control structure related to fog control, other control structures being omitted. It is mainly formed of many components including a controller 40 to provide fog control according to the program.

In addition to the fog control program, the memory section 41 stores the number of rotations of the development sleeve during fog control, the reading of the target fog sensor for various colors, the range of changing the fog control parameter, the number of sheets to be printed, the period of time for the image forming apparatus to be left and others. The fog detection sensor 30 is a reflection type optical sensor. It detects the amount of fogged toner on the intermediate transfer member 20 and inputs the reading into the controller 40. The surface potential sensor 31 detects the surface potential of the photoreceptor 10 and inputs the reading into the controller 40. The temperature and humidity sensor 32 is a sensor for reading the temperature and humidity (not illustrated in FIG. 1). It reads the temperature and humidity where the image forming apparatus is installed, and inputs the reading into the controller 40.

The development sleeve drive motor 137 is a motor for driving a development sleeve 131. In the fog control mode, the controller 40 causes this motor to be switched to the speed of the development sleeve under fog control stored in the memory section 41. This procedure allows the circumferential speed ratio θ of the development sleeve 131 with respect to the circumferential speed of the photoreceptor 10 to be changed (by moving speed ratio change section). The circumferential speed ratio θ is set in such a way that fog occurs more easily under fog control than during normal image formation. Depending on the structure of the developing device, the fog occurs mote easily when the circumferential speed ratio θ is greater than during normal image formation, or it occurs more easily when the circumferential speed ratio θ is smaller. In the present embodiment, fog occurs more easily when the circumferential speed ratio θ is greater. Accordingly, the circumferential speed ratio θ is increased under fog control. The Official Gazette of Japanese Patent Tokkai 2005-3729 discloses an example of the case where the fog occurs more easily when the circumferential speed ratio θ is smaller.

The development bias power source 138 is a power source to apply development bias Vb to the development sleeve 131. Under fog control, the controller 40 provides control in such a way as to output the development bias Vb determined by the output value of the fog detection sensor 30. In the present embodiment, the development bias Vb contains the DC component Vb (DC) and AC component Vb (AC) superimposed thereon. The Vb (DC) value, Vb (AC) peak-to-peak value and Vb (AC) frequency can be controlled by the controller 40.

Under fog control, the charging unit 11 is controlled by the controller 40 so as to provide the charged output determined according to the output value of the fog detection sensor 30. In this case, the controller 40 adjusts the charged output value based on the output value of the surface potential sensor 31.

The pressure release motor 151 of the primary transfer rollers (15Y, 15M and 15C) is a motor to switch the contact pressure of the primary transfer rollers 15Y, 15M and 15C between the fog control of the black image forming section K and that of the yellow image forming section Y, magenta image forming section M and cyan image forming section C. Under the fog control of the black image forming section K, the primary transfer rollers 15Y, 15M and 15C are released by the controller 40. Under fog control of the yellow image forming section Y, magenta image forming section M and cyan image forming section C, the primary transfer rollers 15Y, 15M and 15C are switched over to the state of contact pressure by the controller 40.

Figure 5:
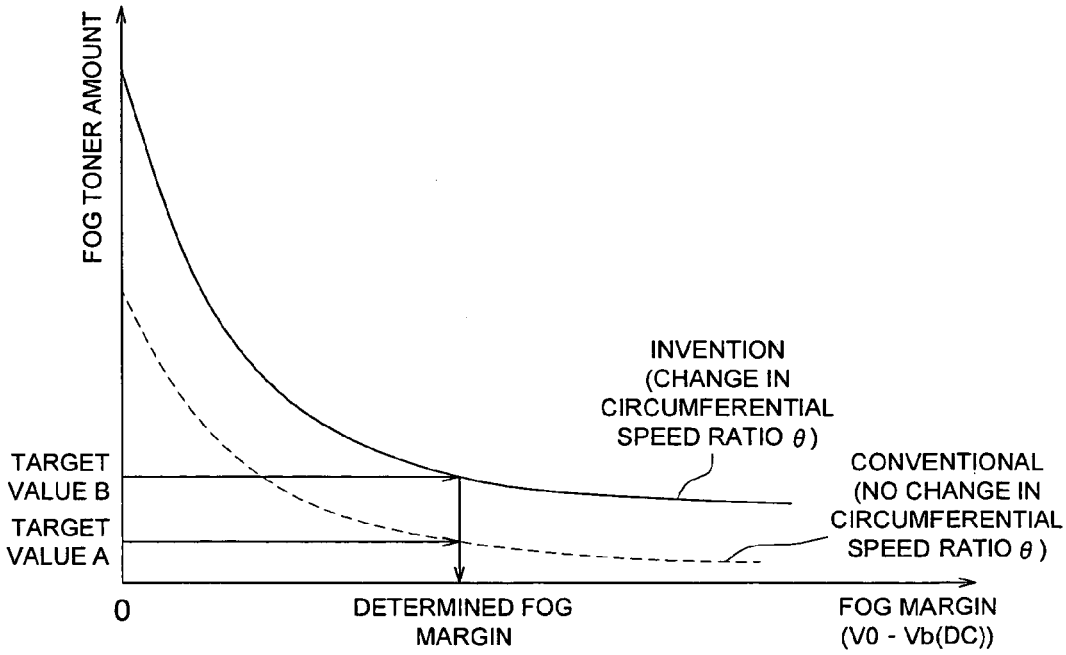
FIG. 5 is a conceptual diagram representing the relationship between the amount of fog toner and fog margin in fog control when the circumferential speed ratio θ is changed in the present invention and when it is not changed in the conventional method.

FIG. 5 is a conceptual diagram showing the relationship between the amount of fog toner and fog margin under fog control when the circumferential speed ratio θ is changed in the present invention, and under fog control when the circumferential speed ratio θ in the conventional method is not changed. The fog margin is defined as the absolute value of the difference between the surface potential V0 of the photoreceptor and the DC component Vb (DC) of the development bias.

Under the conventional fog control where the circumferential speed ratio θ is not changed, the circumferential speed ratio θ is the same as that for normal image formation. The amount of permissible fog toner is equal to the target value A. If the amount of fog toner is detected by the fog detection sensor 30 while the fog margin is changed, the fog margin to achieve the target value A can be obtained. The fog margin can be changed by changing at least one of the surface potential V0 and DC component Vb (DC) of the development bias.

In this case, the amount of the fog toner read by the fog detection sensor 30 is very small. The target value A is close to the resolution of the fog detection sensor 30. Such being the case, the SN ratio is small and it is heavily affected by noise, with the result that detection accuracy is reduced and a high degree of reliability cannot be ensured.

In the meantime, under the fog control according to the present invention where the circumferential speed ratio θ is changed, the circumferential speed ratio θ is changed so that the fog will be produced easily. Thus, the target value B for the amount of fog toner is greater than the target value A. The target value B corresponds to the amount of fog toner when the circumferential speed ratio θ is changed when the fog margin is set so that the target value A before the circumferential speed ratio θ is changed will be reached. The memory section 41 stores, as a target fog sensor reading, the sensor reading taken when the amount of the fog toner of the target value B is detected by the fog detection sensor 30.

In this case, the amount of fog toner detected by the fog detection sensor 30 is greater than that under the fog control without the circumferential speed ratio θ being changed in the conventional method. This ensures a higher SN ratio, a greater resistance to noise, and a higher degree of accuracy and reliability.

In the aforementioned case, the surface potential V0 for changing the value of the fog margin and the DC component Vb (DC) of the development bias were used as fog control parameters. The peak-to-peak value of the Vb (AC) and the frequency of Vb (AC) can also be used for fog control. It goes without saying that a combination of these parameters can also be used for fog control.

Generally, if the peak-to-peak value of the Vb (AC) is reduced, the amount of fog toner tends to reduce. If the frequency of the Vb (AC) is increased, the amount of toner tends to reduce. This trend may differ according to the development system to be used.

Figure 6:
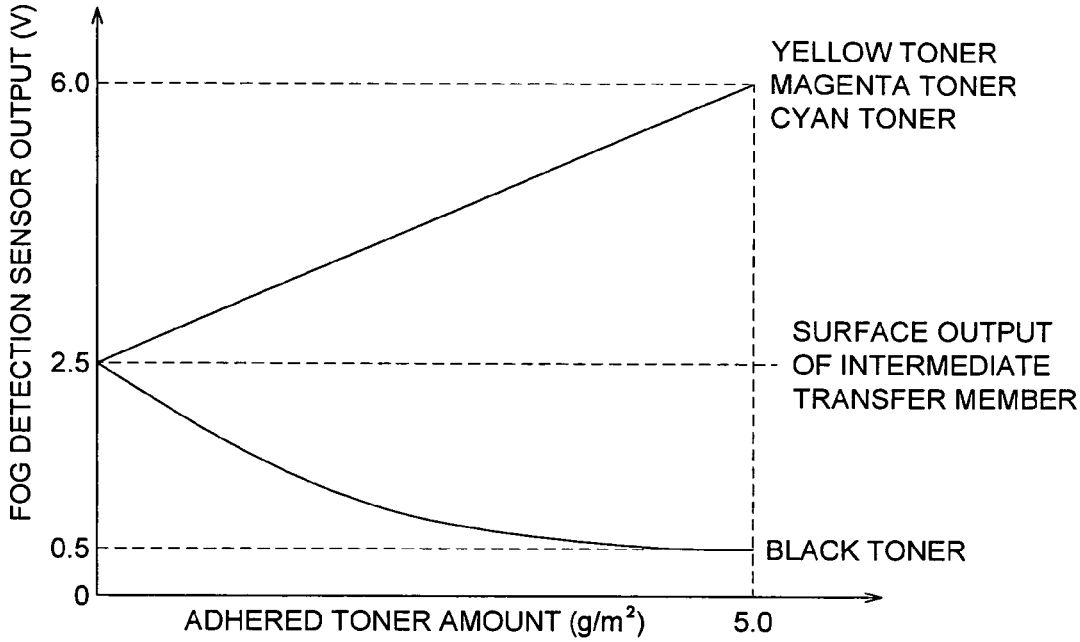
FIG. 6 is a conceptual diagram representing the relationship between the output of the fog detection sensor and the amount of the toner adhered to the intermediate transfer member.

FIG. 6 is a conceptual diagram representing an example of the relationship between the output of the fog detection sensor and the amount of toner adhered to the intermediate transfer member. Adjustment is made to ensure that the output will be 2.5V when the surface itself of the intermediate transfer member 20 is detected by the fog detection sensor 30. The characteristics are different according to whether yellow, magenta, cyan or black toner is used.

The characteristics of the yellow, magenta and cyan toner are such that the output of the fog detection sensor 30 is increased with the amount of toner adhered onto the intermediate transfer member. There is no big difference in characteristics among the yellow, magenta and cyan toner. The characteristics are the same when the yellow toner, magenta toner and cyan toner are superimposed on the intermediate transfer member.

In the meantime, the characteristic of the black toner is such that the output of the fog detection sensor 30 is reduced with the increase in the amount of the toner adhered to the intermediate transfer member.

Figure 7:
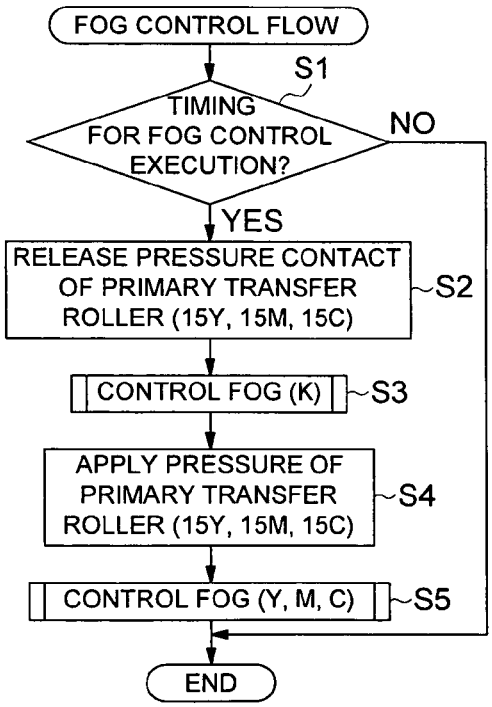
FIG. 7 is a fog control flow diagram of the present embodiment.

FIG. 7 is a control flow diagram representing the fog control in the present embodiment. The controller 40 takes a decision step to determine whether or not the predetermined conditions are met by the number of sheets to be printed, temperature and humidity or period of time stored in the memory section 41 (Step S1). If the controller 40 has determined that the predetermined conditions are met by the number of sheets to be printed, temperature and humidity or period of time to be left (Step S1: Yes), the pressure release motor 151 of the primary transfer roller (15Y, 15M and 15C) is driven and the intermediate transfer member 20 is kept apart from the yellow image forming section Y, magenta image forming section M and cyan image forming section C (Step S2). The intermediate transfer member 20 is constant kept in pressure contact with the black image forming section K. Then the controller 40 executes the fog control of the black image forming section K to be described later (Step S3). This procedure allows the fog control parameter of the black image forming section K to be optimized. This ensures that fog does not occur in the normal image formation. Then the controller 40 drives the pressure release motor 15 of the primary transfer rollers (15Y, 15M and 15C) and causes the yellow image forming section Y, magenta image forming section M, cyan image forming section C to be kept in pressure contact with the intermediate transfer member 20 (Step S4). Then the controller 40 implements fog control of the yellow image forming section Y, magenta image forming section M and cyan image forming section C to be described later (Step S5). Fog control of each of the image forming sections of the yellow image forming section Y, magenta image forming section M and cyan image forming section C is implemented simultaneously. The amount of the adhered toner is detected by the fog detection sensor 30 while the aforementioned toners are superimposed on the intermediate transfer member 20. This arrangement permits the fog control parameters of the yellow image forming section Y, magenta image forming section M and cyan image forming section C to be optimized. Thus, fog does not occur in the normal image formation. In the Step S1, if the controller 40 has determined that the predetermined conditions are not met by the number of sheets to be printed, temperature and humidity or period of time to be left (Step S1: No), the flow terminates.

As described above, the fog control of the yellow image forming section Y, magenta image forming section M and cyan image forming section C is implemented after the fog control of the black image forming section K has been completed and the fog control parameter of the black image forming section K has been optimized. This arrangement ensures that the fog tone of the black image forming section K having different characteristics as described with reference to FIG. 6 does not adhere to the surface of the intermediate transfer member 20 during the fog control of yellow image forming section Y, magenta image forming section M, cyan image forming section C. Thus, the fog detection sensor 30 detects the amounts of fog toner of yellow, magenta and cyan more accurately, with the result that high-precision fog control is ensured.

Figure 8:
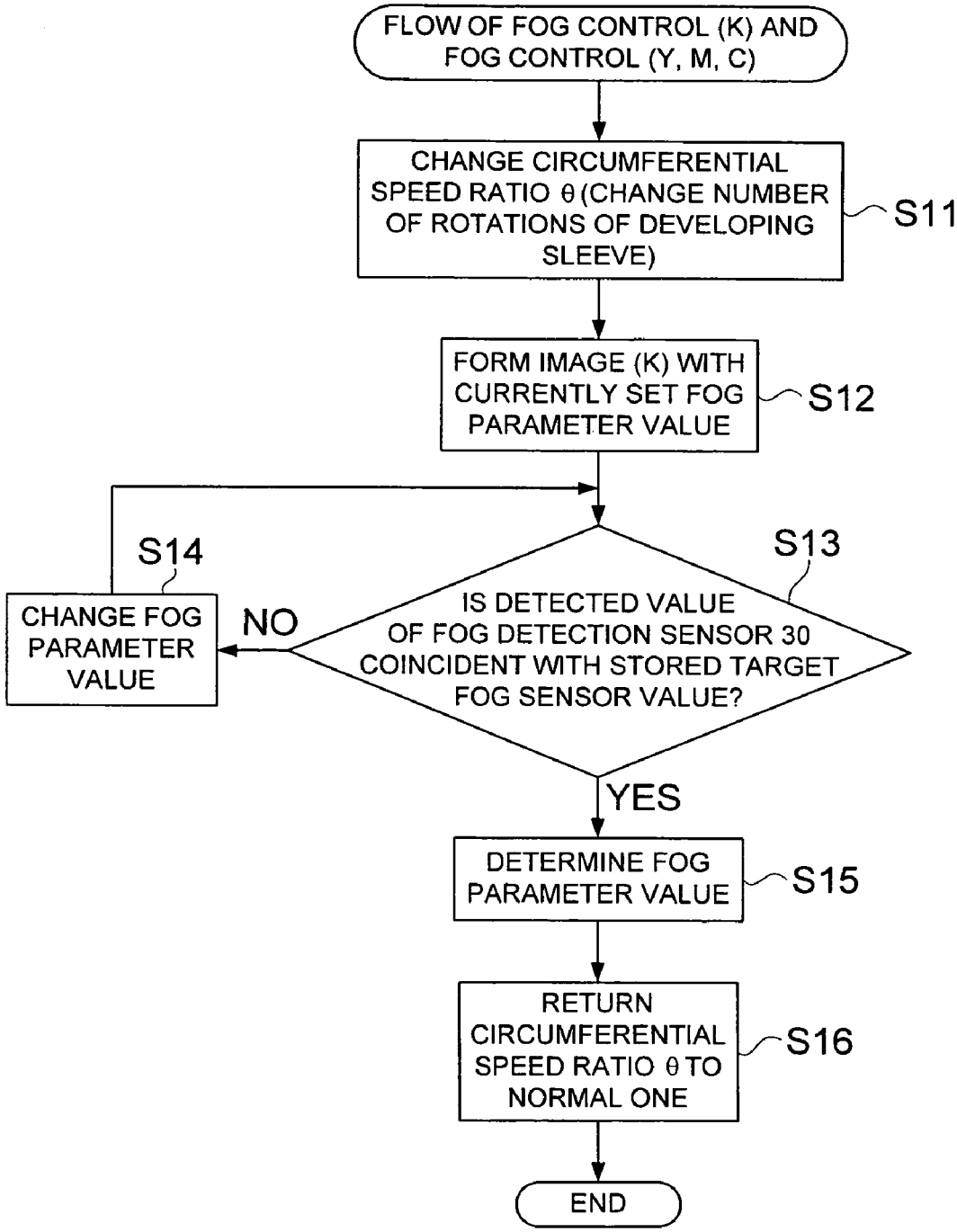
FIG. 8 is a fog control flow diagram for the black image forming section K, yellow image forming section Y, magenta image forming section M and cyan image forming section C in of the present embodiment.

FIG. 8 is a control flow diagram representing the fog control of the black image forming section K in the present embodiment, and the fog control of the yellow image forming section Y, magenta image forming section M and cyan image forming section C. The fog control of the black image forming section K (the aforementioned Step S3) is basically the same as the fog control of the yellow image forming section Y, magenta image forming section M and cyan image forming section C (the aforementioned Step S5).

The controller 40 controls the development sleeve drive motor 137, and changes the speed of the development sleeve 131, whereby the circumferential speed ratio θ is changed (Step S11). In this case, the circumferential speed ratio θ is changed to the level where fog easily occurs. Then the controller 40 controls the image formation of the black image forming section K, using the currently set fog parameter (Step S12). Then the controller 40 takes a decision step to determine whether or not the reading of the fog detection sensor 30 agrees with the target fog sensor reading (a value corresponding to the amount of fogged toner of the target value B) stored in the memory section 41 (Step S13). If the controller 40 has determined that it fails to agree with the target fog sensor reading stored in the memory section 41 (Step S13: No), it changes the fog parameter value (Step S14), and takes a decision step in Step S13 again. In the Step S13, if the controller 40 has determined that the reading of the fog detection sensor 30 agrees with the target fog sensor reading stored in the memory section 41 (Step S13: Yes), the controller 40 determines the fog parameter value in this case as a fog parameter value (Step S15). Then the controller 40 controls the development sleeve drive motor 137, and changes the speed of the development sleeve 131 so that the circumferential speed ratio θ will be returned to the circumferential speed ratio θ at the time of normal image formation. Preparations are now made to start the normal image formation (Step S16).

In the fog control of the yellow image forming section Y, magenta image forming section M and cyan image forming section C in the present embodiment, the image forming sections are controlled synchronously with one another as one integrated member. Fog toners from the image forming sections are superimposed on the intermediate transfer member 20 to form an image. These superimposed fog toners are detected by the fog detection sensor 30. The target fog sensor reading at the time of superimposition of the yellow, magenta and cyan toners is stored in the memory section 41. These values are compared with the values read by the fog detection sensor 30. Then the fog parameter value is determined and the fog parameter of each image forming section is changed likewise. In this manner, fog control operations of the yellow image forming section Y, magenta image forming section M and cyan image forming section C are carried out collectively at a time, whereby the fog control time can be cut down.

In the present embodiment, fog control operations of the yellow image forming section Y, magenta image forming section M and cyan image forming section C are carried out collectively at one time. However, each of the fog control operations can be performed one by one sequentially.

In the present embodiment, fog control is carried out by one fog detection sensor 30 arranged on the intermediate transfer member 20 in order to achieve downsizing and cost reduction. However, a fog detection sensor can be arranged on each of the photoreceptors 10Y, 10M, 10C and 10K, whereby fog control is provided.

In the present embodiment, the present invention is applied to the tandem full color image forming apparatus. The present invention is also applicable to a monochromatic image forming apparatus and others.

What is claimed is:

1. An image forming apparatus comprising:

(a) an image carrier having a movable surface thereon;

(b) a charging unit which electrically charges the surface of the image carrier;

(c) an exposure unit which imagewise exposes the surface of the image carrier charged by the charging unit to form an electrostatic latent image;

(d) a developing unit having a developer bearing member to hold a toner thereon, which develops the electrostatic latent image by moving a surface of the developer bearing member relative to a surface of the image carrier;

(e) a fog toner detection section which detects a value corresponding to an amount of fog toner adhered from the developer bearing member;

(f) a controller which determines a fog control parameter based on the result of detection by the fog toner detection section;

(g) a moving speed ratio change section which changes a circumferential speed ratio between the surface of the developer bearing member and the surface of the image carrier; and (h) a memory section which stores a target value of fog toner, wherein after the circumferential speed ratio has been changed by the moving speed ratio change section, the controller determines the fog control parameter based on comparing the value detected by the fog toner detection section with the target value stored in the memory section, and controls the moving speed ratio change section to return the circumferential speed ratio to the circumferential speed ratio prior to the change.

2. The image forming apparatus of claim 1, wherein the fog control for a yellow, magenta and cyan image and the fog control for a black image are carried out separately.

3. The image forming apparatus of claim 2, wherein the fog control for the yellow, magenta and cyan image is carried out after the fog control for the black image.

4. The image forming apparatus of claim 1, further comprising:

a plurality of image forming sections each having the image carrier, the charging unit, the exposure unit and the developing unit;

an intermediate transfer member to which the toner of each of the plurality of image forming sections is transferred; and a transfer unit provided opposite to each of the image forming sections through the intermediate transfer member, wherein the value detected by the fog toner detection section is an amount of fog toner adhered to the intermediate transfer member by the transfer unit.

5. The image forming apparatus of claim 4, wherein the plurality of image forming sections include image forming sections for yellow, magenta, cyan and black, respective transfer units opposite to the image forming sections for yellow, magenta and cyan, are capable of applying or releasing contact pressure to the respective image carriers of the respective image forming sections through the intermediate transfer member, after the controller releases the contact pressure of respective transfer units for yellow, magenta and cyan and determines the fog control parameter to the image forming section for black, the controller applies the contact pressure of the respective transfer units for yellow, magenta and cyan, and determines the fog control parameter to the image forming sections for yellow, magenta and cyan.

6. The image forming apparatus of claim 5, wherein the respective transfer units for yellow, magenta and cyan are integrated into one unit, and moved synchronically, when the contact pressure is applied or released, the controller determines the fog control parameter to the image forming sections for yellow, magenta and cyan according to a fog toner amount adhered to the intermediate transfer member on which yellow toner, magenta toner and cyan toner are superimposed.

7. The image forming apparatus of claim 1, wherein the fog control parameter is charge voltage to the surface of the image carrier which is charged by the charging unit.

8. The image forming apparatus of claim 1, wherein the fog control parameter is development bias voltage which is applied to the developer bearing member.

9. The image forming apparatus of claim 8, wherein the development bias voltage has an alternate current component, and the fog control parameter is peak-to-peak voltage of the alternate current component.

10. The image forming apparatus of claim 8, wherein the development bias voltage has an alternate current component, and the fog control parameter is frequency of the alternate current component.

11. An image forming method for forming image by developing an electrostatic latent image on an image carrier by a developing device having a developer bearing member; comprising the steps of:

(a) changing a circumferential speed ratio between the surface of the developer bearing member and a surface of the image carrier by a moving speed ratio change section;

(b) detecting a value corresponding to an amount of fog toner adhered from the developer bearing member;

(c) comparing the amount of the fog toner having been detected, with a value corresponding to an amount of a target fog toner stored in a memory section, (d) determining a fog control parameter;

(e) returning the circumferential speed ratio to the ratio prior to the change; and (f) forming an image according to the fog control parameter having been determined.

12. The image forming method of claim 11, wherein the fog control for a yellow, magenta and cyan image and the fog control for a black image are carried out separately.

13. The image forming method of claim 12, wherein the fog control for the yellow, magenta and cyan image is carried out after the fog control for the black image.

* * * * *

UNITED STATES PATENT AND TRADEMARK OFFICE

CERTIFICATE OF CORRECTION

PATENT NO. : 7,574,154 B2
APPLICATION NO. : 11/473101
DATED : August 11, 2009
INVENTOR(S) : Kobayashi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 489 days.

Signed and Sealed this

Fourteenth Day of December, 2010

David J. Kappos

David J. Kappos
*Director of the United States Patent and Trademark Office*